US005532703A

United States Patent [19]

Stephens et al.

[11] Patent Number: 5,532,703

[45] Date of Patent: Jul. 2, 1996

[54] ANTENNA COUPLER FOR PORTABLE CELLULAR TELEPHONES

[75] Inventors: Gerald D. Stephens, Vandalia; Duixian Liu, Dayton, both of Ohio

[73] Assignee: Valor Enterprises, Inc., Piqua, Ohio

[21] Appl. No.: 344,546

[22] Filed: Nov. 23, 1994

Related U.S. Application Data

[63] Continuation-in-part of Ser. No. 50,588, Apr. 22, 1993, abandoned.

[51] Int. Cl.[6] ..... H01Q 1/24

[52] U.S. Cl. ..... 343/702

[58] Field of Search ..... 343/702, 703, 343/720, 831, 901; H01Q 1/32, 1/24

[56] References Cited

U.S. PATENT DOCUMENTS

| | | | |
|---|---|---|---|
| 2,790,899 | 4/1957 | Townsend | 343/720 |
| 3,364,487 | 1/1968 | Maheux | 343/702 |
| 3,518,681 | 6/1970 | Kiepe | 343/702 |
| 3,636,912 | 1/1972 | Kamp | 116/28 |
| 3,826,935 | 7/1974 | Grierson et al. | 310/71 |
| 4,167,738 | 9/1979 | Kirkendall | 343/703 |
| 4,193,076 | 3/1980 | Ito et al. | 343/702 |
| 4,220,955 | 9/1980 | Frye | 343/703 |
| 4,481,647 | 11/1984 | Bachle | 174/65 G X |
| 4,740,794 | 4/1988 | Phillips et al. | 343/702 |
| 5,016,020 | 5/1991 | Simpson | 343/703 |
| 5,243,355 | 9/1993 | Emmert et al. | 343/595 X |

*Primary Examiner*—Donald T. Hajec
*Assistant Examiner*—Steven Wigmore
*Attorney, Agent, or Firm*—Jacox, Meckstroth & Jenkins

[57] ABSTRACT

An extended retractable wire-type antenna of a portable cellular telephone is coupled to a coaxial cable extending from a remote external antenna by a coupler including an elongated body formed by two mating longitudinal sections molded of a rigid plastics material. The body sections have longitudinally spaced opposing hook-shaped tabs which clip onto the extended antenna in response to slight flexing of the antenna. The sections define an internal cavity for receiving the coaxial cable at one end and for positioning an approximately quarter wave length cable conductor element adjacent the extended antenna in parallel relation to produce an effective inductive connection. A plastic screw prevents sliding of the coupler on the retractable antenna.

9 Claims, 2 Drawing Sheets

ANTENNA COUPLER FOR PORTABLE CELLULAR TELEPHONES

RELATED APPLICATION

This application is a continuation-in-part of application Ser. No. 08/050,588, filed Apr. 22, 1993, now abandoned.

BACKGROUND OF THE INVENTION

When a portable cellular telephone is used within a motor vehicle, the user frequently experiences a decrease in performance of the telephone reception and transmission due to the fact that the built-in antenna on the telephone is partially shielded by the metal body of the vehicle. In order to eliminate or minimize this signal degradation problem, it is desirable to connect the antenna on the telephone to a remote externally located antenna which may be mounted on a window or on the vehicle body by a magnetic base. Some portable cellular telephones have a female jack for receiving a plug on a coaxial cable connected to an external antenna. However, many portable telephones do not have such a jack and incorporate retractable, whip-like or flexible wire antennas which usually have a length of about 4 to 4.5 inches and a diameter between 0.075 and 0.095 inch. Such antennas are retractable into the housing of the telephone and are extended when it is desired to use the telephone.

Other types of portable cellular telephones or transceivers have a non-retractable flexible antenna with a helically wound conductor covered by a rubber or plastic tube and commonly known as a "rubber duck" antenna. An R-F coupling device for such an antenna is disclosed in U.S. Pat. No. 4,220,955. This device consists of an inner non-metallic tube or sleeve which is adapted to telescope over the flexible antenna on the transceiver. The inner tube is surrounded by a helically wound conductor or coil, and an electrically conductive cylindrical casing with end caps surrounds the helical coil and insulating sleeve.

SUMMARY OF THE INVENTION

The present invention is directed to an improved antenna coupler which is ideally suited for use with retractable wire-type antennas on portable telephones or transceivers and which is convenient and easy to use for releasably coupling a coaxial cable extending from a remote external antenna to the retractable antenna on the telephone or transceiver. The coupler of the invention is especially easy to attach to an extended retractable antenna while the telephone or transceiver is within a motor vehicle and to release from the retractable antenna when it is desired to remove the telephone or transceiver from the vehicle. The coupler of the invention further provides for obtaining an effective and efficient inductive connection between the center conductor of the coaxial cable and the retractable antenna.

In accordance with one embodiment of the invention, an elongated coupler body is formed by two mating longitudinal sections which are molded of a rigid plastics material. The sections include longitudinally spaced hook-shaped tabs which project laterally from the sections in opposite directions to provide for quickly and positively clipping the coupler body to the retractable wire antenna by slightly flexing the antenna to snap the antenna behind the tabs. The body sections also define therebetween a longitudinally extending internal cavity for receiving and retaining a coaxial cable conductor or a flat metal extension of the conductor having a length of approximately three inches or one-quarter wave length of the telephone frequency range. The body sections also clamp a straight or inverted J-shaped portion of the coaxial cable to provide a strain relief and to position the cable conveniently adjacent the housing of the portable telephone.

Other features and advantages of the invention will be apparent from the following description, the accompanying drawings and the appended claims.

DESCRIPTION OF THE PREFERRED EMBODIMENTS

Figure 1:
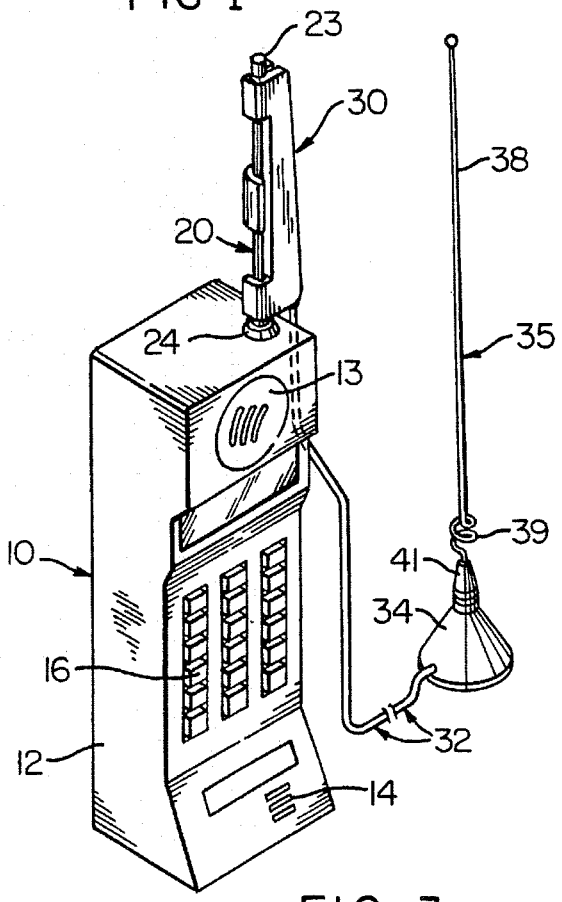
FIG. 1 is a perspective view of an antenna coupler constructed in accordance with the invention and showing its attachment to an extruded retractable cellular telephone antenna for coupling the antenna to a remote external antenna.
Figure 2:
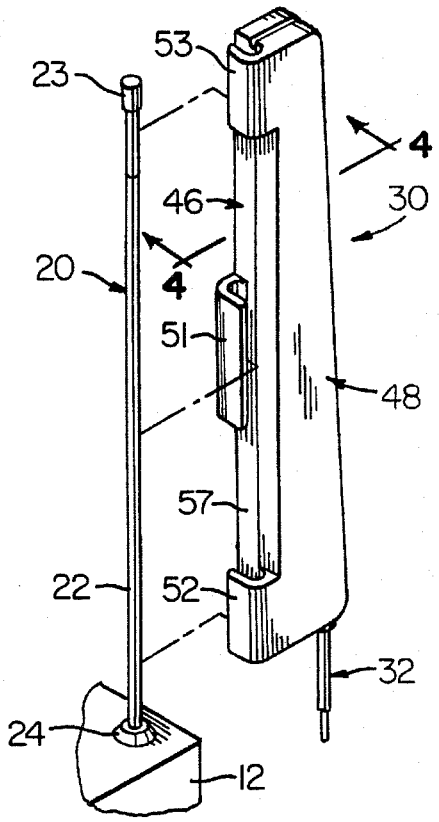
FIG. 2 is an enlarged perspective view of the coupler shown in FIG. 1 and shown exploded from the retractable antenna of the telephone.

FIG. 1 illustrates a transceiver in the form of a conventional portable cellular telephone 10 which includes a housing 12 defining openings for an earpiece 13 and a microphone 14 and a push button keyboard 16. The telephone 10 also includes a retractable flexible antenna 20 which is shown in its extended position in FIGS. 1 and 2. The antenna 20 consists of a flexible stainless steel spring wire surrounded by a coating or layer of electrical insulation material 22 so that the antenna may be flexed through 90° and, when released, springs back or returns to its straight position shown in FIGS. 1 and 2. A cap 23 is secured to the outer end portion of the wire antenna 20 and engages a collar 24 when the antenna is pushed inwardly to its retracted position within the housing 12.

In accordance with the present invention, a coupler device or coupler 30 transmits radio frequency or RF signals between the antenna 20 and a coaxial cable 32 which extends from the base 34 of a remote external antenna 35. The antenna 35 is of a conventional type and includes a flexible stainless steel spring wire element 38 with an integral phasing coil 39. The coil is attached by a threaded fitting 41 to the base 34 which encloses a flat magnet adjacent its bottom surface. The cable 32 may have a length of many feet, and the base 34 is usually attached temporarily to the metal roof of a motor vehicle during use of the vehicle. The coaxial cable 32 may al so extend from a window clip-on antenna or the inside coupler box for a glass mounted antenna, both of which are commonly used on motor vehicles as external antennas for cellular telephones.

The elongated coupler 30 includes a body formed by two longitudinally extending and mating half sections 46 and 48 each of which is molded of a rigid plastics material. The body section 46 is molded with an integrally projecting hook-shaped tab 51 which projects laterally between two longitudinally spaced hooked-shaped tabs 52 and 53 molded as an integral part of the body section 48 and projecting laterally in the opposite direction. The section 46 also includes a longitudinally extending recess or cavity 56 which is parallel and adjacent a flat edge surface 57. The cavity 56 receives a linear portion 61 of a twisted center wire metal conductor of the coaxial cable 32. The twisted wire conductor portion 61 has a length of about three inches which is approximately one-quarter wave length of the frequency range used for cellular telephone transmission.

Figure 3:
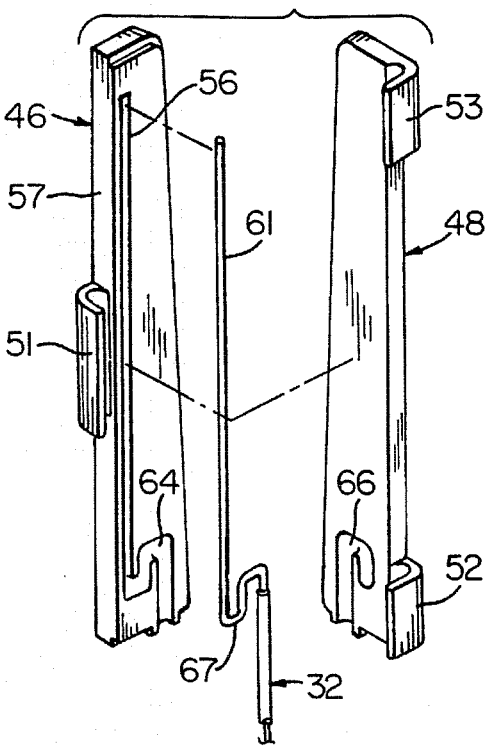
FIG. 3 is an exploded perspective view of the components for the coupler shown in FIGS. 1 and 2.
Figure 4:
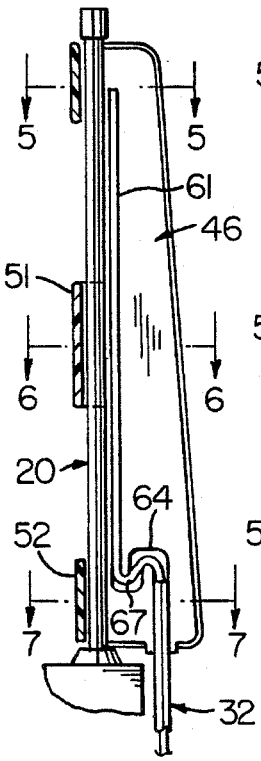
FIG. 4 is a fragmentary section of the coupler, taken generally on a line 4—4 of FIG. 2.
Figure 5:
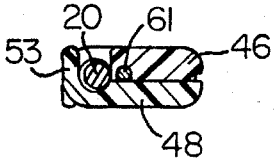
FIGS. 5–7 are fragmentary sections taken generally on the lines 5—5, 6—6 and 7—7 of FIG. 4.
Figure 6:
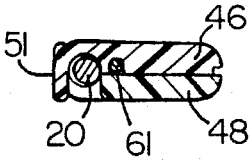
Figure 7:
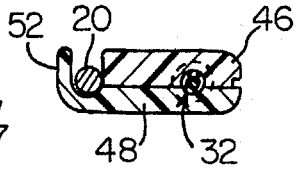

The linear conductor portion 61 includes a tubular insulating sleeve of plastics material, and this insulating sleeve or layer is surrounded within the cable 32 by a braided metal wire shield which is surrounded by an outer sleeve or layer of plastics material. An S-shaped cavity 64 is formed within the base portion of the body section 46, and an inverted J-shaped cavity 66 is formed within the base portion of the body section 48, as shown in FIG. 3. The center conductor has an S-shaped portion 67 which extends into the cavities 64 and 66 to form a strain relief for the cable 32, as shown in FIG. 4. After the conductor portions 61 and 67 are inserted into the corresponding cavities 56 and 64 within the body sections 46 and 48, and the coaxial cable 32 is placed within the cavities 64 and 66, the mating sections 46 and 48 of the coupler 30 are cemented or ultrasonically welded together. After the body sections are attached together, the cable 32 and conductor portions 61 and 67 are secured within the corresponding cavities. The abutting surfaces of the body sections 46 and 48 may be provided with longitudinally spaced cylindrical pins and corresponding tight-fitting holes (not shown) for quickly and precisely aligning and retaining the body sections together during curing of the adhesive.

The coupler is easily attached to the extended retractable antenna 20 by simply hooking the lower tab 52 onto the antenna and then manually flexing the antenna slightly to locate the antenna within the tabs 51 and 53, as shown in FIGS. 1 and 4. After the coupler 30 is clipped onto the antenna 20 in this manner, the coupler is positively retained on the antenna 20 and also prevents or blocks the antenna from being accidentally pushed inwardly towards its retracted position. As also apparent from FIGS. 1 and 4, when the coupler 30 is attached to the antenna 20, the coaxial cable 32 projects from one end of the body sections and downwardly along the side of the housing 12. Thus the cable may be enclosed within a hand gripping the telephone 10 to prevent the cable from accidentally hooking onto an object. The coupler 30 may also be quickly removed from the antenna 20 simply by gripping the outer cap 23 of the antenna and flexing the outer end portion of the antenna 20 from behind the tab 53. The coupler 30 may then be rotated slightly to remove the antenna 20 from the tabs 51 and 52.

Figure 8:
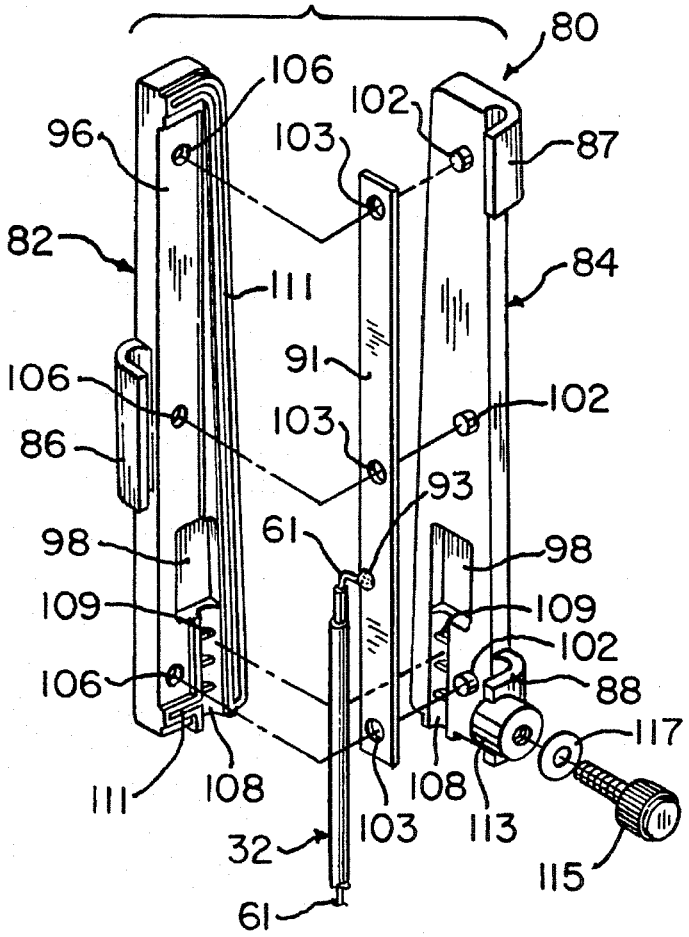
FIG. 8 is a view similar to FIG. 3 and showing a modified coupler constructed in accordance with another embodiment of the invention.
Figure 9:
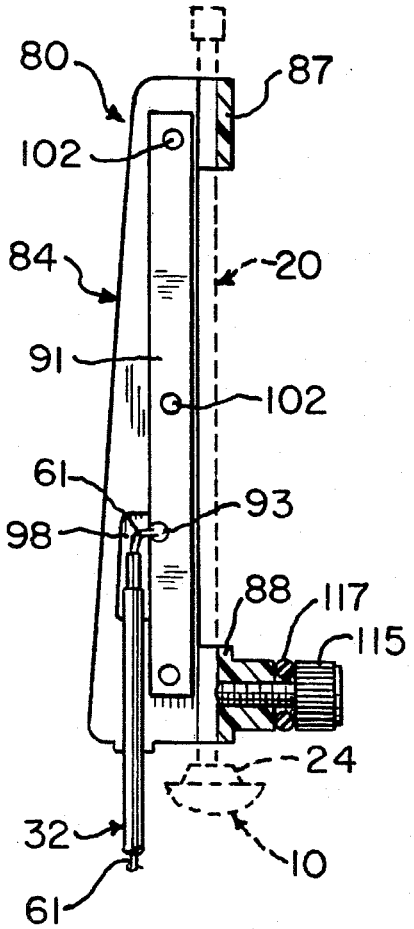
FIG. 9 is a view similar to FIG. 4 of the embodiment shown in FIG. 8.

Referring to FIGS. 8 and 9 which show another embodiment of the invention, a coupler device 80 is constructed very similar to the coupler device 30 and includes mating elongated plastic body sections 82 and 84 which have corresponding outwardly projecting hook-shaped tabs 86,87 and 88. In this embodiment, in place of using the center wire conductor 61 of the coaxial cable 32 to provide the inductive pick up or connection between the antenna 20 and the coaxial cable 32, a thin flat metal conductor or brass strip 91 is connected or attached to the wire conductor 61 by the solder connection 93. The flat brass conductor 91 seats within an elongated recess or cavity 96 within the body section 82, and the soldered connection 93 is located within mating cavities 98 within the body sections. A set of three pins or studs 102 are molded as an integral part of the body section 84 and project through corresponding holes 103 within the flat conductor 91 and into corresponding blind holes 106 within the body section 82 to locate the conductor 91 as it is sandwiched between the body sections 82 and 84 and to position the body sections with respect to each other.

A pair of mating cavities 108 are molded within the bottom portions of the body sections 82 and 84, and each cavity has a set of longitudinally spaced ribs 109 which engage or grip the resilient insulation on the coaxial cable 32 and form a strain relief or positive connection between the cable 32 and coupler device 80 when the body sections 82 and 84 are assembled for clamping the cable 32 within the cavities 108 and for clamping the strip conductor 91 between the body sections. Before the body sections 84 and 86 are assembled or clamped together with the cable 32 and conductor 91 confined between the body sections, a bead 111 of contact cement or adhesive is extruded onto the body section 82 for securing the body sections 82 and 84 together after assembly.

The coupler device 80 also includes a nut 113 which is molded as an integral part of the tab 88 and has an internally threaded hole for receiving a molded plastic screw 115 which carries a resilient O-ring 117. As shown in FIG. 9, when the screw 115 is threaded through the nut 113, the pointed tip of the screw 115 presses the antenna 20 against the tab 88 and thereby holds the coupler device 80 on the antenna so that the coupler device does not shift or slide longitudinally on the antenna.

As apparent from the drawing and the above description, an antenna coupler constructed in accordance with the present invention provides a number of desirable features. For example, the coupler 30 or 80 may be quickly and easily attached by one hand to an extended antenna 20 and may also be quickly and easily released from the antenna. By also locating the linear conductor 61 or 91 in close parallel relation or close proximity to the antenna 20, that is, within about 0.125 inch, the conductor 61 or 91 provides an effective inductive pick up or connection between the antenna 20 and the coaxial cable 32 so that very little signal is lost. The coupler 30 or 80 also provides for directing the coaxial cable 32 from the coupler adjacent the side of the telephone housing 12 so that the cable 32 does not interfere with convenient use of the telephone 10. In addition, the screw 115 prevents the coupler from sliding on the antenna 20.

While the forms of coupler herein described constitutes preferred embodiments of the invention, it is to be understood that the invention is not limited to these precise forms of coupler, and that changes may be made therein without departing from the scope and spirit of the invention as defined in the appended claims.

The invention having thus been described, the following is claimed:

1. A coupler adapted for inductively connecting a flexible coaxial cable extending from a remote external antenna on a motor vehicle to an elongated flexible wire-like retractable antenna of a portable cellular telephone, said coupler comprising an elongated body of substantially rigid plastics material and including two opposing and mating elongated body sections secured together, said body sections including a plurality of longitudinally spaced and substantially rigid hook-shaped tabs projecting in opposite directions for releasably and positively attaching said body laterally to the retractable antenna in response to flexing of the retractable antenna for engaging said tabs, an elongated electrical conductor connected to the coaxial cable, and said conductor is confined between said opposing body sections and extends generally parallel and adjacent the retractable antenna to obtain an effective inductive connection between said conductor and the retractable antenna.

2. A coupler as defined in claim 1 wherein two of said longitudinally spaced tabs project laterally of one said body section in one direction, and a third said tab is spaced between said two tabs and projects laterally of the other said body section in the opposite direction.

3. A coupler as defined in claim 1 wherein said opposing body sections define a cavity extending from one end of said body for receiving said conductor and said coaxial cable and for positioning said cable closely adjacent the telephone when said coupler is attached to the retractable antenna.

4. A coupler as defined in claim 1 wherein said body said sections cooperatively define a strain relief cavity for receiving a portion of the coaxial cable to avoid pulling of the cable from said body.

5. A coupler adapted for inductively connecting a flexible coaxial cable extending from a remote external first antenna on a motor vehicle to a flexible elongated second cellular phone antenna of a portable cellular telephone, said coupler comprising an elongated body including two mating elongated body sections, attachment means for releasably attaching said body sections to the second cellular phone antenna with said body extending generally parallel to the second cellular phone antenna, said sections confine therebetween an electrical conductor connected to said coaxial cable, said conductor extends substantially parallel and within 0.125 inch of the second cellular phone antenna to obtain an effective inductive connection between the conductor and the second cellular phone antenna, one of said body sections includes a nut portion defining a hole, and a screw extends through said hole for engaging said second antenna to secure said coupler to said second antenna.

6. A coupler as defined in claim 5 wherein said attachment means comprise a plurality of longitudinally spaced hook-shaped tabs on said body sections and positioned to receive and hook the second antenna in response to slight flexing of the second antenna for engaging said tabs.

7. A coupler as defined in claim 6 wherein two of said longitudinally spaced tabs project laterally of one of said body sections in one direction, and a third said tab is spaced between said two tabs and projects laterally of the other said body section in the opposite direction.

8. A coupler as defined in claim 5 said sections cooperatively define a strain relief cavity for receiving a portion of the coaxial cable to avoid pulling of the cable from said body.

9. A coupler as defined in claim 1 wherein said conductor comprises a thin flat strip of metal.

* * * * *